United States Patent [19]

Hegarty

[11] Patent Number: 4,508,320

[45] Date of Patent: Apr. 2, 1985

[54] FENCE SYSTEM

[76] Inventor: Bernard L. Hegarty, 3746 Oakland Rd., Bethlehem, Pa. 18017

[21] Appl. No.: 323,088

[22] Filed: Nov. 19, 1981

[51] Int. Cl.[3] ..... B21F 27/00

[52] U.S. Cl. ..... 256/47; 256/60

[58] Field of Search ..... 256/47, 32, 65, DIG. 5, 256/67, 66, 72, 59, 60, 68; 403/246, 230, 331

[56] References Cited

U.S. PATENT DOCUMENTS

| | | | |
|---|---|---|---|
| 1,631,942 | 6/1927 | Thomson | 256/52 |
| 1,650,245 | 11/1927 | Thomson | 256/65 X |
| 2,195,072 | 3/1940 | Bauer | 256/65 |
| 2,800,305 | 7/1957 | Gerstuer | 256/65 |
| 3,370,836 | 2/1968 | Ashworth et al. | 256/47 |
| 3,410,527 | 11/1968 | Uroshevich | 256/32 |
| 3,778,175 | 12/1973 | Zimmer | 403/187 |

FOREIGN PATENT DOCUMENTS

| | | | |
|---|---|---|---|
| 2904520 | 8/1980 | Fed. Rep. of Germany | 403/230 |
| 1383621 | 11/1964 | France | 256/65 |

*Primary Examiner*—Andrew V. Kundrat
*Attorney, Agent, or Firm*—Ruth Moyerman

[57] ABSTRACT

A total fence system for wire mesh fences is disclosed. An angle iron post which may serve as a gate, terminal or corner post is utilized. The post includes staples, preferably stamped out lancings which accommodate a slide-in tension bar. The tension bar is inserted intermittently in the wire mesh lancings where it is held fast. A post cap, preferably with slots to accommodate the tension bar ends and which also includes apertures for a top rail, is also disclosed. A unique channeled slug connector is utilized to connect top rail and line post by sliding part of the slug into a slotted top rail and allowing the other part to drop into the hollow line post. Further embodiments adapt the fence system to industrial applications where, for example, barbed wire is an included feature.

7 Claims, 16 Drawing Figures

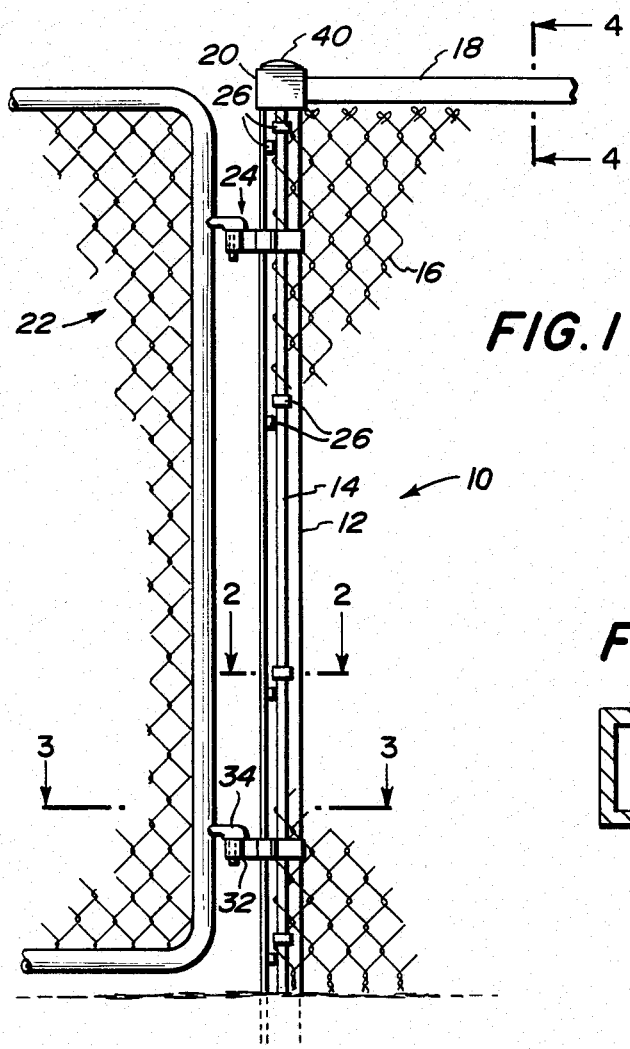
FIG. 1
FIG. 4
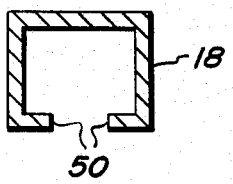
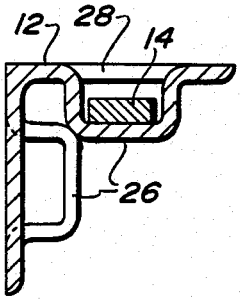
FIG. 2
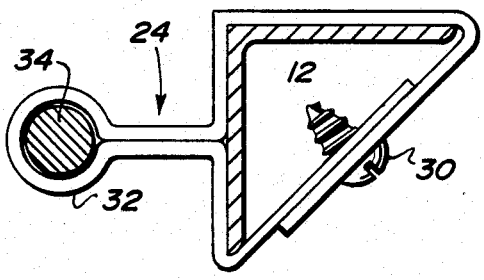
FIG. 3

FIG. 10
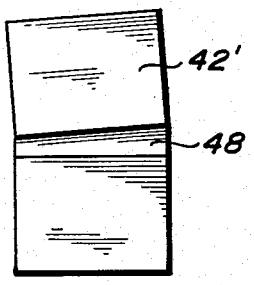
FIG. 11
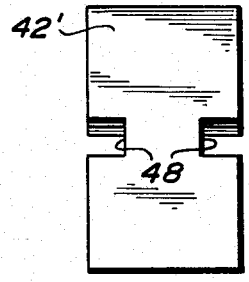
FIG. 12
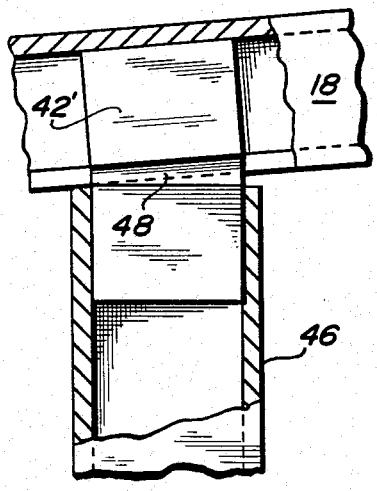
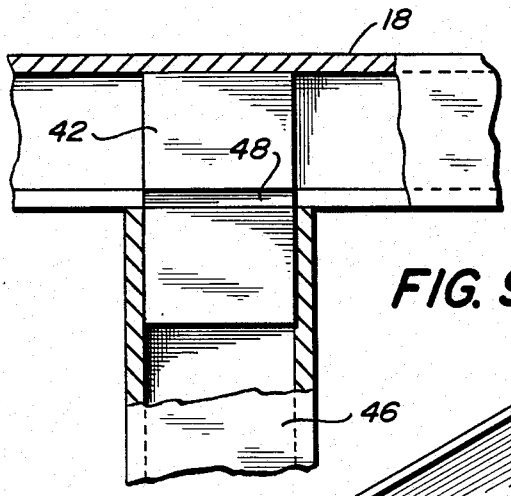
FIG. 9
FIG. 13
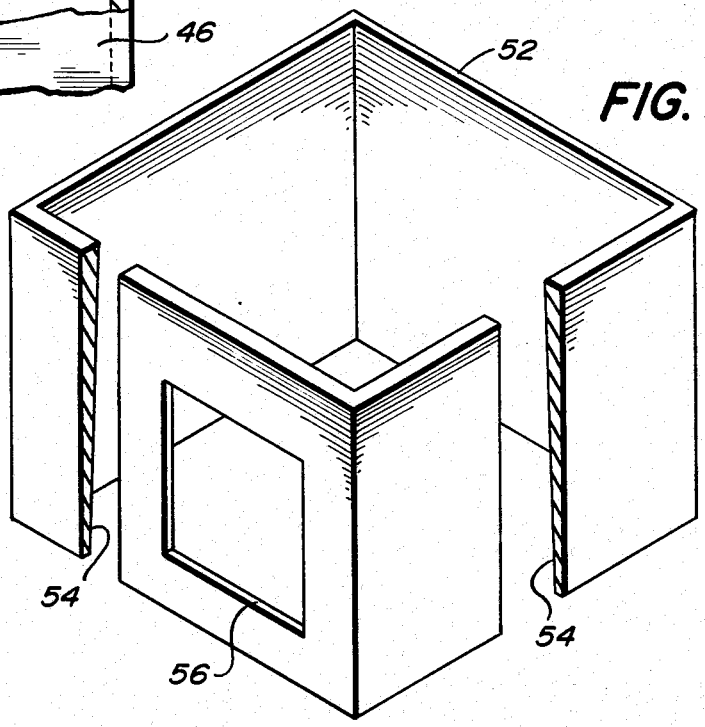

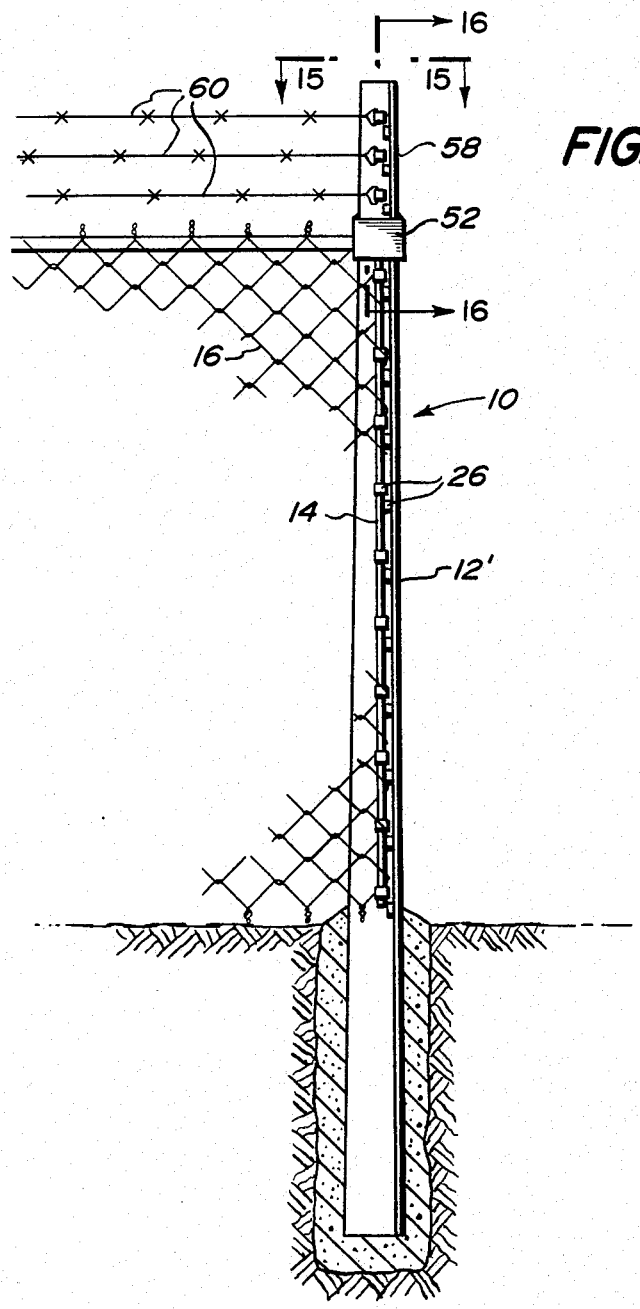
FIG. 14
FIG. 16
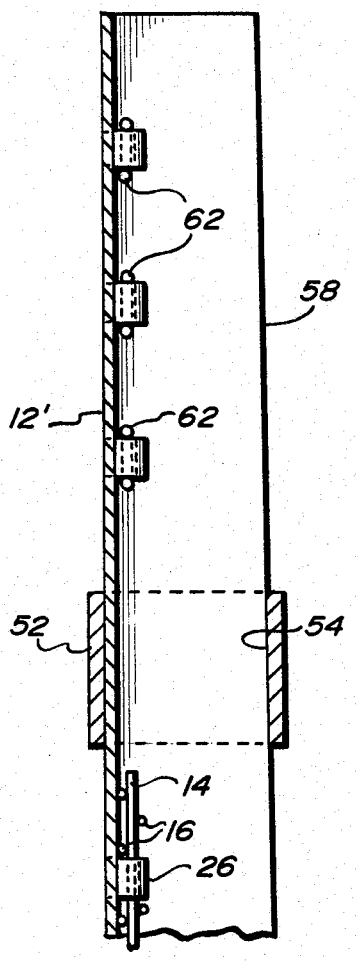
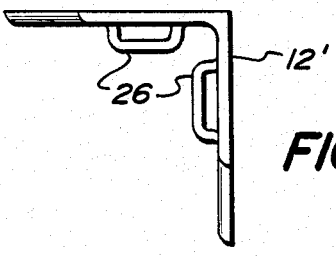
FIG. 15

FENCE SYSTEM

BACKGROUND OF THE INVENTION

1. Field of the Invention

This invention relates to fences, and more particularly to metal fence systems.

2. Description of the Prior Art

Wire mesh fences, also commonly called chain link fences, are widely utilized throughout the country today. The fences are strong and consist of metal fence posts to which wire mesh is attached.

To install a chain link fence, the fence post is first installed, customarily by encasing it in concrete below ground level. The chain link fabric is stretched taut between posts and the fabric is attached to the post by the bands. Additionally, tension bands and stretcher bars may be included. Intermediate support, if needed, is provided by additional posts, commonly referred to as line posts. In addition, brace assemblies are required in some fence applications and these assemblies occur at the terminal posts.

There are, however, many disadvantages to chain link fencing. Chief among these is the problem of attaching fence fabric to the fence post. Conventional methods employ a multitude of small parts including tension bands, brace bands, stretcher bars and assorted nuts and bolts. Thus, the installation of these fences is performed almost universally by professionals, and is relatively expensive because of the labor involved and the multitude of parts that the installer must inventory.

In an effort to simplify installation by reducing the parts needed, some proposals have been made to interweave wire meshing with the post itself. U.S. Pat. No. 3,410,527 to Uroshevich is an example of this application. Another is Ashworth et al, U.S. Pat. No. 3,370,836. These references have not truly solved the problem. It has been found that the interweaving of mesh is difficult because of the inherent strength of the material, and that the finished job has frequently stretched the metal into an unsightly appearance.

Furthermore, although metal posts including angle bar posts are known (for example U.S. Pat. No. 1,359,704), here the posts include either holes or slots such as the '704 patent, or are intended for wire weaving such as the 40 836 patent.

No fence system is known which simultaneously eliminates both band connectors and wire weaving.

There is, therefore, still a need for a convenient, truly versatile, low cost fence post system which will allow the installer to connect the wire mesh to the post with both a minimum of hardware and a minimum of effort.

SUMMARY OF THE INVENTION

The aforementioned prior art problems are solved by the fence system of this invention. This invention contemplates an angle bar universal terminal post. The post may be used as a gate post, end post and corner post. It includes horizontally disposed staples, preferably lancings, along its length. A rigid tension bar is also disclosed. The tension bar is interwoven with the wire mesh of the fence material while being slipped into the staples of the fence post. In the example of the terminal post where the post is intended as a corner post, lancings on both bends of the angle bar are utilized. Where the post is intended as an end post or a gate post, only lancings on one side are needed.

The system also contemplates a post cap which is adapted to overfit the end of the post and which is slotted to receive the tension bar ends as well as an aperture to receive a top rail. In examples where the fence is to be used for industrial applications where barbed wire or other above-fence wire is contemplated, the post cap is open-ended on both ends to slip over the post, dropping down part way to form a sleeve cap.

Other embodiments of the invention include a connector for joining a top rail to a line post in those instances where a line post supporting a fence midsection is desired. In this embodiment, a two-ended connector, preferably a parallelpiped with parallel spaced-apart channels grooved into each side to form the connector's two ends interfaced with a neck portion. The top rail includes a slotted underside running its entire length and the connector is inserted into this slot through its neck portion. A line post is joined to the top rail by dropping the connector bottom end into the hollowed top of the line post.

It is, therefore, an object of this invention to provide the fence system which eliminates the need for band attachment of post and fence fabric, together with the concomitant nuts and bolts.

It is also an object of this invention to provide a fence system which is compatible with today's chain link fence and which permits a simplified interweaving of fence fabric with fence post.

It is yet another object of this invention to provide a fence system suitable for both home and commercial needs which is readily adaptable to all terrains and may be installed with ease.

It is still another object of this invention to provide a fence system which is, in every way, the same strength and integrity as prior fence systems, but which results in a fence system which is inexpensive to produce, easy to install, safe to use, and low cost to maintain.

These and other objects will be more readily ascertainable to one skilled in the art from a consideration of the following figures, description and exemplary embodiments.

BRIEF DESCRIPTION OF THE DRAWING(S)

FIG. 1 illustrates a back, partial view of the fence system showing the post used as a terminal or gate post including the wire mesh connection to the tension bar.

FIG. 2 is a cross section taken on lines 2—2 of FIG. 1.

FIG. 3 is a cross section taken on lines 3—3 of FIG. 1.

FIG. 4 shows a cross section taken on lines 4—4 of FIG. 1.

Figures 6, 7, 8:
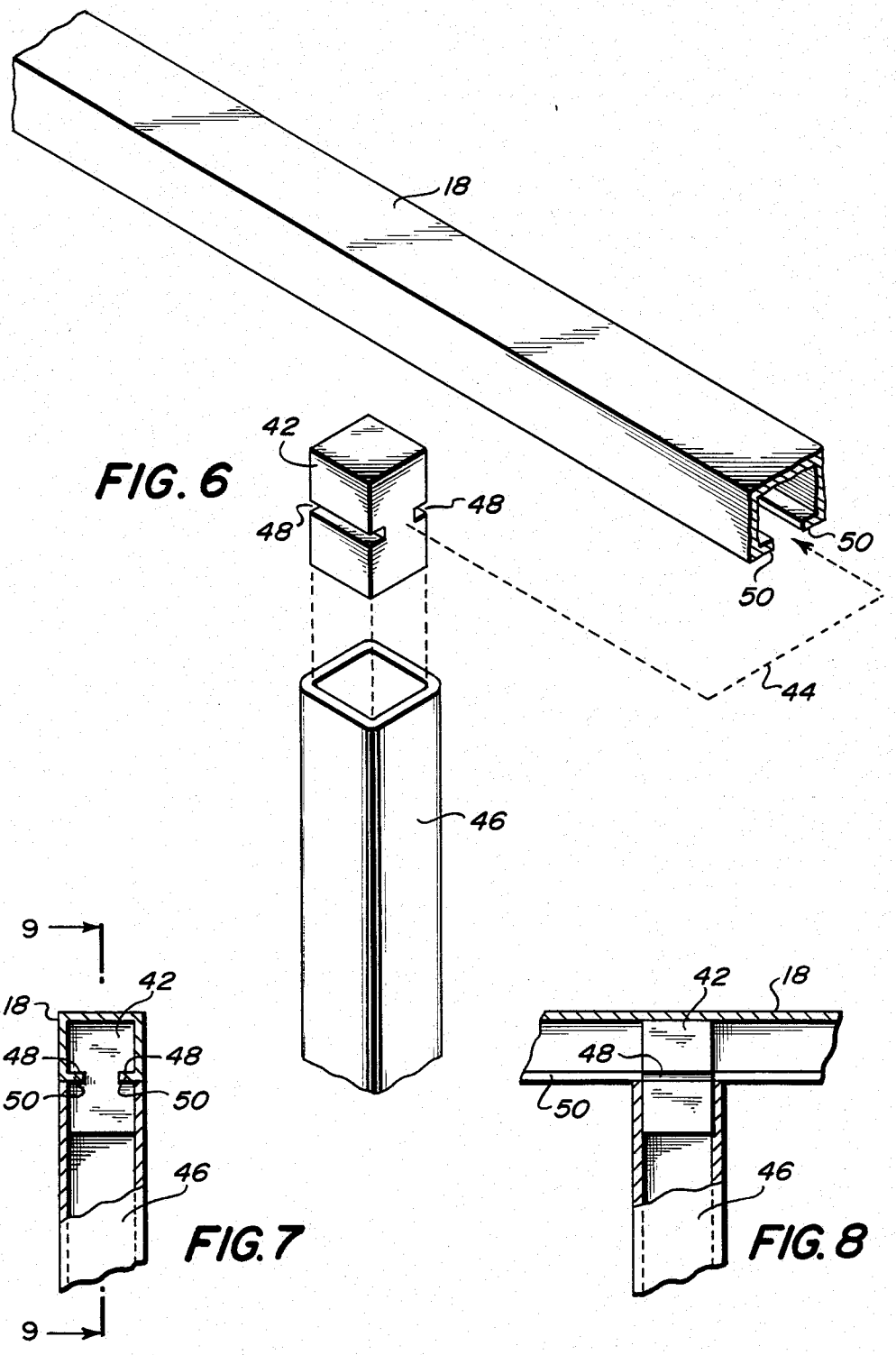
FIG. 6 shows an isometric exploded view of the line post, top rail and line post connector of this invention in relationship to the line post and top rail.
FIG. 7 shows an end view in cross section of the line post connector, line post and top rail as they would appear connected.

FIGS. 8 and 9 are identical and are both cross sections taken on lines 9—9 of FIG. 7. FIG. 9 is repeated to allow a side-by-side comparison with FIGS. 10, 11 and 12.

FIG. 10 is a side view of an alternate embodiment of the slug connector adapted to accommodate an installation where the ground slopes.

FIG. 11 is a front view of the slug connector shown in FIG. 1.

FIG. 12 is a cross section of the slug connector shown in FIGS. 10 and 11 as it would look in an installation.

FIG. 13 illustrates a top elevation of an open-ended cap.

FIG. 14 shows a view from the inside-looking-out of an alternate embodiment of the corner post of this invention adapted for an industrial application.

FIG. 15 is a top view of the corner post of FIG. 14.

FIG. 16 is a section taken on lines 16—16 of FIG. 14.

DETAILED DESCRIPTION OF THE PREFERRED EMBODIMENT(S)

Referring now to the drawings, and more particularly to FIG. 1, a partial view of the fence system of this invention, generally 10, is shown from the inside of a fenced area looking out. FIG. 1 shows particularly post 12 being utilized in this illustration as a gate post. FIG. 1 also shows tension bar 14, wire mesh 16, top rail 18 and post cap 20 with post 12. Gate 22, depicted in broken view, attaches to fence system 10 by gate post hinge 24 in the conventional manner. Gate 22 itself is a conventional gate and forms no part of this invention.

The view in FIG. 1 shows the interweaving of tension bar 14, wire mesh 16 and post 12. Fence system 10 is installed by first embedding post 12 in the ground in cement or by other means well known in the art. Thereafter, tension bar 14 is slipped into post 12 and held by staples 26 which are preferably lancings stamped directly from post 12 itself as shown in more detail in FIG. 2. As tension bar 14 is inserted through staples 26, it is intermittently interwoven with mesh 16. FIG. 1, which is a from-the-back view or inside view, shows the end result, a unified fence mesh joining together without brace bands, etc.

Referring now to FIG. 2, a detail taken on section 2—2 of FIG. 1 is shown. In this view, the preferred embodiment in which the staples 26 are lancings stamped from post 12 itself are better shown. It should be noted that in the view shown in FIGS. 1 and 2, post 12 is being utilized as a gate post and therefore only the lancings on one side are being utilized. Post 12, to increase its versatility, may serve as both a gate post, an end post or a corner post as will be discussed in connection with FIG. 5.

The view in FIG. 2 shows tension bar 14 nestled within the cutout formed by staple 26 and held in place by wall 28 which is in fact one side of post 12. Post 12 is most conveniently an angle iron, a conventional, well known steel product.

Referring now to FIG. 3, a gate post hinge 24 is shown. The view in FIG. 3 is taken on section 3—3 of FIG. 1 and shows an adaptation of a hinge connector to the triangular cross section needed to accommodate the angle shape of fence post 12. Gate post hinge 24 is held together by screw 30 and has, as a part of it, female member 32 adapted to receive male member 34. Male member 34 is a part of gate assembly 22 as shown in FIG. 1.

Referring now to FIG. 4, top rail 18 is shown in cross section. From FIG. 4 it may be ascertained that top rail 18 is generally channel-shaped and in this embodiment is shown as a parallelpiped. Tubular or other shaped rails may be substituted so long as they perform the function of support and protection for the fence mesh at its top edge.

Figure 5:
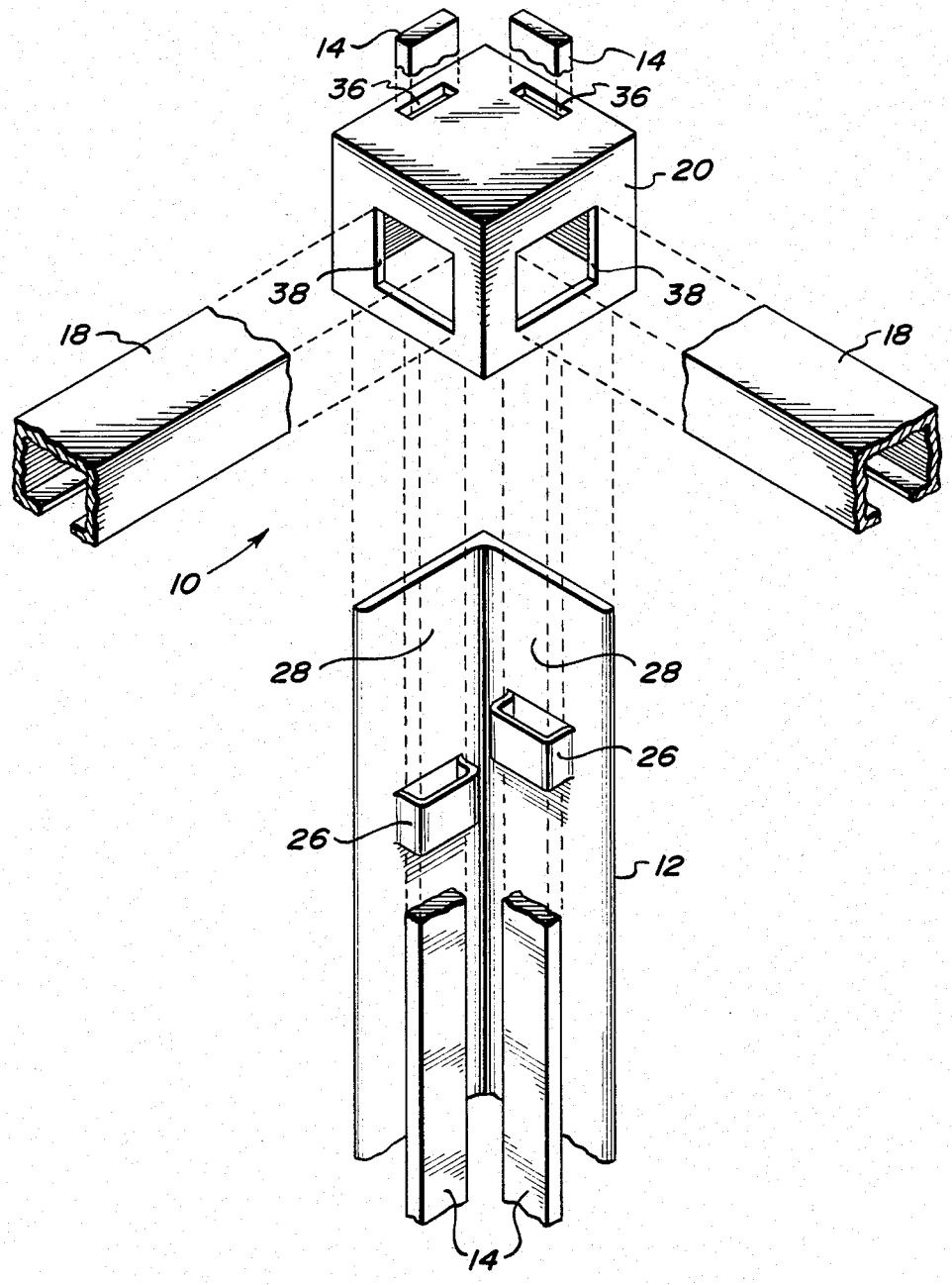
FIG. 5 is an isometric, exploded view of the gate post and post cap of this invention when used as a corner post.

Referring now to FIG. 5, post 12 is shown in partial view used as a corner post. In the view shown in FIG. 5, tension bar 14 is one of a pair of tension bars. In this embodiment, both walls 28 of post 12 would be utilized. To simplify understanding of the drawing, wire mesh 16 is omitted but post cap 20, shown in exploded view, is shown in more detail. In regard to post cap 20 shown in this embodiment as generally cubic, slots 36 are provided. Slots 36 are used to accommodate an end of tension bar(s) 14 and provide further stability for tension bar(s) 14 and overall more integrity for fence system 10. Aperatures 38, intended to receive top rail(s) 18, are also shown in more detail.

While post cap 20 has been shown as a cube in this embodiment, other designs are permissable so long as they cap the post and provide the apertures necessary to accommodate top rail 18. Slots 36 are preferable as a means to accommodate and hold the end of tension bar 14. Design features may be added to the post cap as, for example, in FIG. 1 where the cap is shown with a slight dome 40 added for decorative purposes.

Referring now to FIG. 6, a line post and top rail connection is shown. A line post is a post used at intermittent intervals along a fence system to provide rigidity to the otherwise flexible wire mesh. In FIG. 6, wire mesh 16 is omitted to allow a better understanding of this part of the system. When present, wire mesh 16 could be fastened to line post 46 by wire loops or other conventional means. Top rail 18 is shown in exploded view and would, in use, be connected to line post connector 42 as indicated by arrow 44. Line post connector 42 is shown as a slug with overall dimensions approximating the interior dimensions of top rail 18 and line post 46. In order to effect the connection, line post connector 42 includes a pair of channels 48 which mate with returns 50 of top rail 18. It is apparent from the illustration that the dimensions of line post connector or slug 42 are a function of the dimensions and shape of line post connector 42 and top rail 18 into which it must slidably fit in registration as shown.

As shown in FIG. 6 and again in cross section in FIGS. 7, 8 and 9, line post connector 42 drops into line post 46, releasably resting in this position.

Referring now to FIG. 7, a cross section of the assembled views of FIG. 6 is shown as seen from an end. The view in FIG. 7 illustrates the relationship between connector 42 and the two pieces it is joining.

Referring now to FIGS. 8 and 9, a section taken on lines 8—8 of FIG. 7 is shown, also in cross section, to provide a side view of line post connector 42, post 46 and rail 18. Again in this view it may be seen that the slug connection provides a simple and versatile, but effective, means of joining line post to top rail.

FIG. 9 is identical to FIG. 8 and is repeated on the same sheet as FIG. 12.

Referring now to FIGS. 10, 11 and 12, a variation of the slug is shown in FIGS. 10 and 11 and of the top rail-to-line post connection of FIG. 9 is shown in FIG. 12 as an alternate embodiment intended for an adaptation of fence system 10 to a sloped terrain. In the view in FIG. 10, a side view of the line post connector 42′ is shown in which channel 48 is shown as a converging section instead of the parallel section shown in the foregoing three Figures.

With reference to FIG. 11, a front view of connector 42′ is shown, again illustrating the converging channel section needed to accommodate an uneven terrain installation.

Referring now to FIG. 12 which is a side view in cross section of top rail 18 connected to line post 46 utilizing connector 42'. In FIG. 12, the versatility of this simple line post connector and the ease with which it solves the problem of varying slopes and terrains which are a problem of fence erection is readily understandable by comparing the figure with FIG. 9 and noting that a simple change in slug design will accommodate all terrains.

The remaining Figures show the adaptability of fence systems 10 to industrial or heavy duty installations as well as the aforementioned light duty or residential uses.

Referring specifically to FIG. 13, an open-ended cap 52 is illustrated. This cap is particularly suitable for industrial installations and includes tapered slots 54 and apertures 56 which will be discussed in reference to FIG. 14. FIG. 13 illustrates both a "right hand" and "left hand" tapered slot in the same cap although only one tapered slot would actually be utilized per cap as is shown in FIG. 16.

With reference now to FIG. 14, a from-the-inside looking out view of fence system 10 as an industrial application is shown. In industrial applications, heavier duty construction is generally required. Post 12 of FIG. 1 may become a tapered member, shown here as 12', with a tapered larger end forming the ground connection shown in cross section to illustrate an inground installation. It becomes apparent, thus, that the tapered slots 54 as shown in FIG. 13 are needed to accommodate the changed cross section of post 12' and this cross section is illustrated further in FIG. 15 which is a top view of post 12' to indicate the increasing section size nearer the ground.

With reference back again to FIG. 14, the top opening of cap 52 is utilized to allow cap 52 to be slidably mounted intermittent post 12' to provide an upwardly extending portion 58 to act as anchor means for barbed wire 60 in those applications where this extra measure of security is desired.

Referring now to FIG. 16, a cross section taken on lines 16—16 of FIG. 14 is shown to better illustrate the relationship of open cap 54 to post 12' and its upper end 58. In this view, barbed wire connector 62, staples 26, together with wire mesh 16 are visible.

There are many advantages to be realized by the use of this invention.

In all posts, corrosion by the elements may be a problem. With conventional round posts, the problem is exacerbated by lack of air circulation in the hollow center. The post of this invention, with its open angle configuration, reduces the corrosion problem.

For fence dealers, the fence system of this invention offers the opportunity to reduce inventory by eliminating bands and fittings. The system is easier to install and reduces manpower requirements, all leading to a competitive advantage and lower costs to the consumer.

For the consumer, the system has additional advantages. Fittings and bands which act as foot and toe holds for climbing children are gone. The unsightly appearance caused by these parts is also gone leaving a trim, weather resistant, easily installed and maintained complete fence system appropriate for all needs.

What is claimed is:

1. A fence system comprising:

(a) A sheet metal angle bar suitable as a gate or terminal post, said post including a generally right angle bend to form two faces, said post further including horizontally disposed staples spaced linearly along the longitudinal axis of at least one of said faces, said staples adapted to receive a slide-in tension bar;

(b) a rigid tension bar of generally the same longitudinal length as said post, said tension bar having a shape in cross section adapted to allow the bar to simultaneously slide into and be retained by said post staples, and to slide into and retain a fence wire mesh, whereby said mesh is connected to said post; and, (c) a post cap adapted to overfit said post end and said cap top is slotted to receive said tension bar(s) end, and further including at least one aperture to receive a top rail.

2. The fence system according to claim 1 wherein said staples are lancings.

3. The fence system according to claim 1 wherein said cap is generally square in configuration.

4. The fence system according to claim 1 wherein said cap is generally dome-shaped in configuration.

5. A fence system comprising:

(a) a sheet metal angle bar suitable as a gate or terminal post, said post including a generally right angle bend to form two faces, said post further including horizontally disposed staples spaced linearly along the longitudinal axis of at least one of said faces, said staples adapted to receive a slide-in tension bar;

(b) a rigid tension bar of generally the same longitudinal length as said post, said tension bar having a shape in cross section adapted to allow the bar to simultaneously slide into and be retained by said post staples, and to slide into and retain a fence wire mesh, whereby said mesh is connected to said post; and, (c) an open ended post cap adapted to overfit said post end in a sleeve fit and further including at least one aperture to receive-a top rail.

6. The fence system according to claim 1 wherein said fence system further comprises:

(d) a hollow line post member;

(e) a hollow top rail member, said top rail member including a slotted portion traversing the member end to end; and (f) a two-ended connector, the ends being joined by a neck between them, the first end being of a size and shape adapted to slidably fit within the hollow top rail, and said second end being of a size and shape adapted to releasably drop within said line post hollow interior, the connecting neck being adapted to slide along said top rail slot, whereby said line post and said top rail may be coupled through said connector.

7. A connector for coupling a post to a slotted fence top rail comprising a two-ended member, the first end being of a size and shape adapted to slidably fit within a hollow fence top rail, and said second end being of a size and shape adapted to releasably drop within a hollow fence post, and wherein said neck is formed as a bridge between a pair of spaced apart, parallel channels grooved one each into each side of said connectors, said channels being in a plane intersecting a plane formed by the terminus of said connector's first end, whereby said fence system may be erected on generally sloped ground.

* * * * *